United States Patent [19]

Jupin et al.

[11] Patent Number: 4,527,700

[45] Date of Patent: Jul. 9, 1985

[54] CLOSURE DEVICE FOR A NECKED CONTAINER

[75] Inventors: Alain Jupin; Bernard Schneider, both of Sainte Menehould, France

[73] Assignee: Cebal, Clichy, France

[21] Appl. No.: 586,749

[22] Filed: Mar. 6, 1984

[30] Foreign Application Priority Data

Mar. 7, 1983 [FR] France ..... 83 04092
May 26, 1983 [FR] France ..... 83 09110

[51] Int. Cl.[3] ..... B65D 1/02
[52] U.S. Cl. ..... 215/32; 215/226; 215/256
[58] Field of Search ..... 215/32, 226, 253, 302, 215/303, 256; 220/258

[56] References Cited

U.S. PATENT DOCUMENTS 4,111,325 9/1978 Bellamy et al. ..... 215/253 X
4,402,417 9/1983 Corrigan, Jr. et al. ..... 215/253 X
4,405,053 9/1983 Cherot ..... 215/32

*Primary Examiner*—Steven M. Pollard
*Attorney, Agent, or Firm*—Dennison, Meserole, Pollack & Scheiner

[57] ABSTRACT

A closure device for both smooth necked and threaded necked containers includes a tamperproof cap frangibly affixed to the container for selective removal by manipulation of the cover. Upon breaking the tamperproof seal by cover manipulation, the cap may be retained within the cover to avoid disposal problems and to serve as a sealing component when the container is resealed after initial opening occurs.

11 Claims, 18 Drawing Figures

FIG. 2
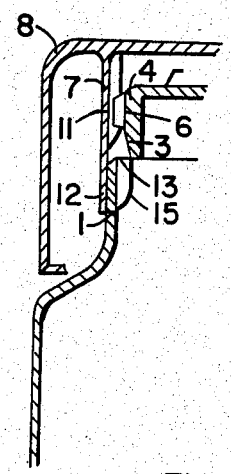
FIG. 3
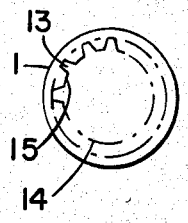
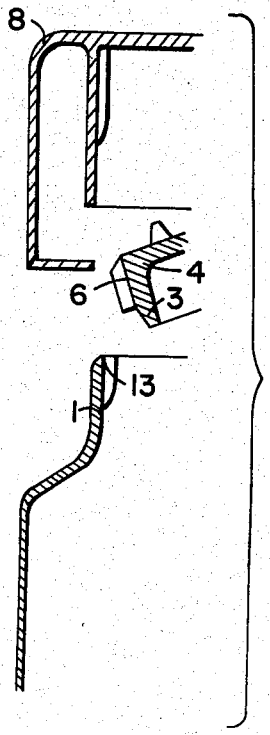
FIG. 4
FIG. 5
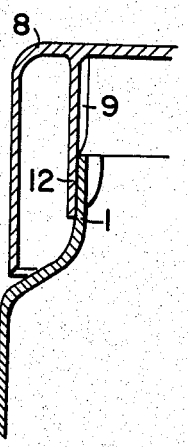

CLOSURE DEVICE FOR A NECKED CONTAINER

The invention concerns the field of tamperproof containers with necks and their covers.

According to the prior art, bottles or plastic containers can be made tamperproof by providing frangible closures over the neck. In French Pat. No. 2,045,875, the top part of the neck of the container is connected by a thin flange to the skirt of the protective cap, and this flange is broken in sections by rotating or pushing this protective cap down, and a distributor cap can then be screwed in and will provide the seal. This container is particularly designed for medications and it is difficult to open. The existence of a separate distributor cap is a complication.

In European Patent Application No. EP-A-0 001 959, the threaded neck of a flexible tube is extended by a blind tube portion which is also threadably connected to the end of the neck by a frangible zone of lesser diameter, and during the rotation of the cap which is threaded to the neck and the blind tube which extends it, the cap first contacts the end of the threads of the blind tube and further rotation will break the frangible zone.

The present invention relates to a container with a neck provided with a cover and a tamperproof closure fitted over the neck. The tamperproof closure includes a base member and a frangible cap provided with a plurality of radially extending flanges. A cover portion includes a complementary flanged key and the cooperation of the cover key with the flanges on the frangible cap facilitates breaking the seal of the cap by rotation of the cover.

The cover generally conceals the tamperproof cap and may have a smooth outer surface configuration and diameter approximately the same as or slightly less than the diameter of the body of the container. The cover may be shaped to limit interengagement with the shoulder or body of the container. The interengagement of the flanges on the cap and of the key of the cover is such that the components are aligned with respect to each other and unintended relative rotation is inhibited. The complementary flanges of the cap and the flanges of the key of the cover fit together, but they may have different shapes. More particularly, the flanges of the closure may be fillets, while the cover key flanges may be constituted of a rim having internal ribs interengaging with said fillets. Upon intentional rotation of the cap relative to the closure, the cap is frangibly detached from the container neck and remains captured within the cover.

Another feature of the invention is the inclusion of a concentric rim encircling the key of the cover and extended downwardly by a skirt of approximately the same inside diameter as the outside diameter of the neck of the container. Accordingly, this skirt telescopingly engages the neck during initial mounting of the cover for storage and display of the container. The skirt serves an additional function as a centering means for the cover on the neck of the container, centering this cover by axially aligning the tube key within the cover key and supporting the cover on the container both prior to original opening and upon reclosure thereafter.

Another feature of the invention is the employment of the separated frangible cap as a closing means to close the container after the frangible seal has been broken. In particular, the frangible cap includes a flange and the cover key includes a concentric slightly conical edge configured to engage the neck of the container and reposition the separated cap over the mouth of the container. The tamperproof cap thus, after breaking, becomes a sealing cap. The interengaging flanges of the cap and the flanges of the key of the cover are preferably configured so that they fit together by frictional force, thus remaining interengaged with the cover after fracture of the seal. The cover then carries the sealing means and the closure and sealing of the container is greatly facilitated after the initial opening.

In an alternative embodiment of the invention, the container neck and the cover include complementary threaded portions allowing the cover to be rotatably attached to close the container after initially breaking the tamperproof seal. The container neck thus includes an external threaded section and the cover includes complementary internal threads on an intermediate annular rim between the outside skirt and the cover key. The threaded zone will thus allow tightening and sealing of the fractured cap means which has been retained within the cover after the seal is broken.

Another embodiment of the invention contemplates a container with a neck provided with a cover as above wherein the neck is externally threaded and wherein the skirt of the tamperproof cap is threaded on and positively affixed on the external threads. The necked container can be formed of plastic material or a metal-plastic compound, polished metal, bare or covered glass, porcelain or ceramic, and the cap including a skirt threaded internally at its base can typically be affixed thereto by any suitable means, such as welding, adhesive, or by local deformation. The skirt of the cap has a tear zone at the level of the edge of the dispensing opening. The broken cap can have means at its base for closing the container, constituted as in the preceding of a flange and the broken skirt. The outside of the part of the skirt which is threaded on and definitively affixed on the neck can itself have an external threaded portion engaging the cover.

Yet another embodiment of the invention is a closure device of a container with a neck provided with a cover comprising a tamperproof cap on the neck of the container which includes flanges on its periphery and a cover equipped with a key fitting on the flanges to allow breaking of the seal of the cap by rotation of the cover relative to the container and this device is characterized in that the base of the cap includes an outwardly flared skirt attached obliquely to the edge of the opening of the neck during injection. The device obliquely arranged on the circumference of the flared skirt of the base of the cap has the effect that after breaking the seal along the frangible zone at the point of attachment of the skirt with the edge of the dispensing opening and optionally with several points of the inside surface of the neck, the base of the cap can be pushed down in the dispensing opening during resealing.

When the opening is generally circular, the flared skirt of the cap provides an adequate seal for closing the container for storage, especially when the diameter of the opening is relatively large, for example, between 4 and 15 mm. The angles of flare of the flared skirt are not critical to the precision of injection of the bottom lip of the cap essentially parallel to the axis of the opening of the neck. Once the cap is fractured, it can be used for the resealing in combination with or without the cover and its base may then be pushed down into the opening even if the configuration of the fractured end differs from the configuration of the opening because the flared end is not thick, e.g. 0.2 to 0.4 mm, is flexible like the lip of a sealing joint. This resealing thus provides an acceptable seal for temporary storage.

When the opening is of varied pattern, i.e. has a wavy configuration, the end of the flared skirt of the cap is also attached obliquely at the edge of the cap and the neck by injection. The end of the skirt of the cover is formed, on the one hand, of parts welded to the edge of the flange parts of the dispensing opening at the point where the injection cone meets the mouth of the opening and, on the other hand, by lips of thermoplastic material which extend between the mouth and the cap. The lips extend between the mouth of the opening and the bottom of the cap regardless of cap and mouth configuration. The terminus of the flared skirt provides an improved semi-seal of the cap and opening and this semi-seal is in fact better than that obtained with a bottom lip injected essentially parallel to the axis of the opening. Such an improvement is customarily obtained with injections at angles of 30° to 80°, preferably from 45° to 70° with the axis of the opening. In this approach, the end of the flared skirt of the cap constitutes a frangible zone providing discontinuous resistance and its welding to the neck is not secure and does not have marked mechanical strength except on the edge of the flange parts of the contour of the opening in the neck, and this thus facilitates the breaking of the seal of the cap. After breaking the seal, the end of the flared skirt of the cap can be pushed down in the opening and the contour of the end of the broken cap is essentially complementary to the contour of the opening. The flexibility of the fractured end allows the cap to enter the opening even if the two contours are not aligned precisely with each other and the end of the broken part of the cap exceeds the size of the contour of the opening. The partial flexing of the end of the flared skirt during application of the cap into the neck opening contributes to retention of this semi-sealed resealing means.

When the base of the cap includes a flared skirt, as previously noted, the rim of the cover key which fits this cap may have a smaller outside diameter than the outside diameter of the neck. In this instance, an intermediate rim having an inside diameter approximating the outside diameter of the container neck is employed. This intermediate rim can engage the neck during the mounting of the cover for storage and display of the container and it can then be forced further down on the neck once the broken cap is detached, i.e. pushed down for resealing.

In those instances when resealing is accomplished using the cap with flared skirt after breaking the seal of the cap, the flanges of the head of the cap and those of the cover key fit together preferably by some slight frictional force so that the cap is retained by the cover key once its flared skirt is broken. The cap is then aligned relative to the cover and the resealing of the container is accomplished easily by mounting and pushing the cover down on the neck. For such resealing, the limit position for application of the cap down in the cover key can be established either by the end of the injection core of the cap when then comes to abut in the bottom of the cover, or by the length of the skirt extending the rim of the cover keys when it abuts on the flared skirt of the cap.

The resealing is accomplished by wedging the fractured cap in the cover key and the quality of this resealing is improved by configuring the cover to include a skirt with an external diameter slightly smaller than or approximately equal to the smallest inside diameter of the neck opening, i.e. to the diameter corresponding to the flange parts of the opening so that the rim of the cover key penetrates into the opening during resealing. The limit position of the cover is then determined either by the length of the intermediate rim or by the length of the outside skirt of the cover. Abutment of the intermediate rim on the shoulder of the container at the base of the neck may also serve as a limit stop.

When the cap is equipped with a flared skirt, particularly when the neck opening is circular or even has irregularities which are not deep and preferably are less than 1 mm, the device can still employ complementary threaded portions on the container neck and the cover allowing a threaded resealing. The threaded portion of the cover part is then preferably carried by an intermediate rim which engages the neck during mounting of the cover for storage and display of the container and which can be forced further down and can be screwed in on the neck once the cap is broken to assure improved resealing of the container.

Examination of the drawings shows six particular examples of the closure according to the invention. The containers are shown in diagrammatic form with skirt length limited according to the various embodiments before filling and closing the bottom end of the container by any suitable means. The same reference numbers or letters are used for the elements which are similar in each view and have the same function.

FIG. 2 is a fragmentized half cross-section in which the opening of the neck is of varied pattern and the cover fully applied.

FIG. 3 is a plan view of one configuration of the dispensing opening.

FIG. 4 is an exploded partial cross-section of the closure of FIG. 2.

FIG. 5 is a lengthwise partial cross-section with the cover replaced over the dispensing opening.

Figure 1:
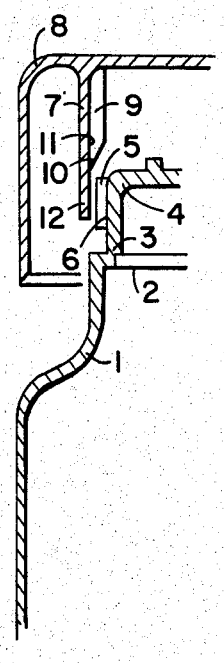
FIG. 1 is a fragmentized half cross-section in which the opening of the neck is circular and the cover partially applied.

Referring now to the container illustrated in FIG. 1, the neck 1 defines a round dispensing opening 2 on the edge of which is welded or cast the tapered bottom edge 3 of the cap 4. The slightly tapered bottom edge is configured to control the resistance of the cap to fracturing by rotation of the cover as will be described more fully hereinafter. The head of cap 4 includes radial flanges 5 and constitutes the key 6 of the tube. The overall diameter of the cap is slightly smaller than the inside diameter of the rim 7 of cover 8 which includes internal ribs 9 with tapered ends 10 to facilitate the interdigitation of tube key 6 with the cover key 11. Rim 7 extends downwardly beyond the key portion and defines a smooth skirt portion 12. The smooth skirt engages tube key 6 to align the tube key and cover key 11.

A second example seen best in FIG. 2 of the drawings differs from the first only by the presence of an irregular dispensing opening 13 on neck 1. This irregular opening 13 may have a variety of shapes of which FIG. 3 gives one example. The crown of the injection points 14 (FIGS. 2 and 3) corresponds essentially to the inside apexes 15 of the irregularities of the contour of the opening so that the interconnection of the bottom 3 of the skirt of cap 4 provides an improved resistance to inadvertent fracture and an improved seal at the points 15 between these points where the thermoplastic sheet can be less strong and perhaps incompletely sealed. These features of the connection of skirt end 3 with neck 1 at the edge of irregular opening 13 may vary with the shape of the dispensing opening.

The present description is applicable to the embodiment of FIGS. 1 and 2. FIG. 2 shows the cover is fully engaged prior to opening. Skirt 12 of rim 7 of cover 8 has an inside diameter nearly the same as the outside diameter of neck 1 of the container so that neck 1 fits within this skirt 12 during the mounting of the cover 8 for storage and display of the container. The aligning cover 8 by interengagement of the neck 1 within skirt 12 completes the alignment and interfitting of tube key 6 in cover key 11.

Cover key 11 is thus held more securely on the head of the cap and interengagement with tube key 6, in which configuration the container may be opened by rotation of cover 8 relative to the tube body. Rotation of the cover in either direction, e.g. through an angle of between 30° and 60°, will fracture the frangible interconnection between the cap and neck. FIG. 4 illustrates opening 13 of the neck 1 separated from cap 4. Cap 4 carrying tube key 6 may be separated by twisting the bottom end 3 of its skirt relative to the neck 1. The cap may then be removed and discarded and the cover 8 replaced and fully engaged with the neck 1 for reclosing the container (FIG. 5). The descent of skirt 12 on neck 1 is then limited only by ribs 9. The seal achieved by such closing is imperfect but is entirely suitable, for example, for storage of pasty products or storage of upright containers in the course of use of the product therein.

Figure 6:
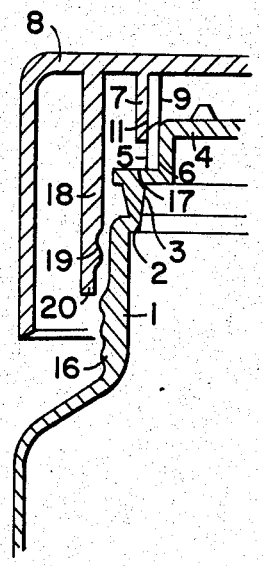
FIG. 6 is an axial lengthwise partial cross-section of an unopened container.
Figure 7:
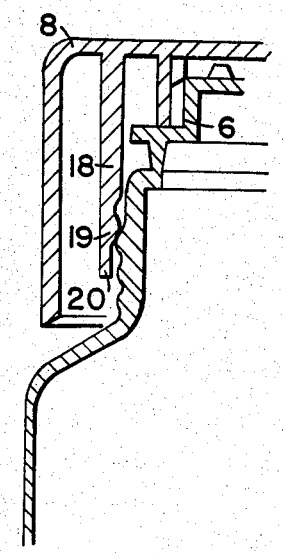
FIG. 7 is an axial lengthwise partial cross-section of the illustration of FIG. 6 in which the cover is fully applied prior to fracture of the seal.

The third example concerns an improved closure device comprising, in addition to the above means, threaded elements and locking closure means. FIG. 6 illustrates a container including a neck 1 with an external threaded portion 16 at its base. A preferably circular dispensing opening 2 is provided under a frangible tamperproof cap 4. A tapered skirt 3 is surmounted by a closure ring 17 terminating in a filleted cap constituting tube key 6 and including flanges 5. Closure ring 17 has a diameter approximating the outside diameter of neck 1. Tube key 6 has a somewhat smaller diameter. A cover 8 includes a key portion 11 consisting of a rim 7 and ribs 9 and interdigitates with flanges 5 on tube key 6 and the positioning of the cover 8 is then at least partially guided by closure ring 17 (FIG. 7). Cover 8 also has an intermediate rim 18 carrying an internally threaded portion 19 at the lower end. While cover 8 is being applied, the lower end of the intermediate rim 18 engages the threaded portion of the neck 1. The lower end 20 of rim 18 is of a tapered configuration and serves as an aligning means for cover 8 and helps hold the cover more securely on tube key 6, thus facilitating the subsequent opening of the container by rotation of cover 8 relative to the neck 1.

Figure 8:
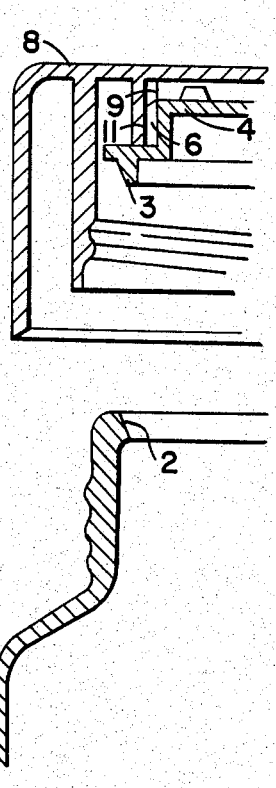
FIG. 8 is an exploded axial lengthwise partial cross-section, following breaking the seal of the cap and raising the cover with the cap remaining captured within the cover.
Figure 9:
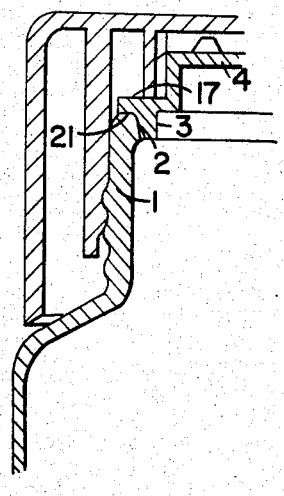
FIG. 9 is an axial lengthwise partial cross-section of the invention illustrated in FIG. 8 after reclosure.

After opening of the container 1 (FIG. 8) by rotatively fracturing the seal between the bottom lip 3 of tamperproof cap 4, the flanges 5 of the head of the cap or "tube key" 6 and ribs 9 of cover key 11 are further engaged and cap 4 is frictionally retained by key 11 within cover 8. The bottom lip 3 of cap 4 is slightly conical in shape at least on its outside circumference so that when cover 8 is mounted (FIG. 9) and threaded onto the neck, the bottom lip 3 penetrates into opening 2 and closure ring 17 is engaged with edge 21 (FIG. 9) of the top of neck 1. The sealing means 3 and 17 thus play the role of an edge joint and they are used in the device according to the invention whether it has or does not have threaded retention means so that following fracture of the seal of the tamperproof cap, the container may be reclosed by simply pushing down or applying the cover by threaded engagement thereof.

Figure 10:
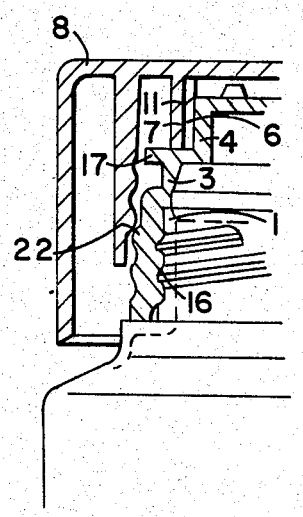
FIG. 10 is an axial lengthwise partial cross-section in which an intermediate threaded part is threaded onto the container neck.
Figure 11:
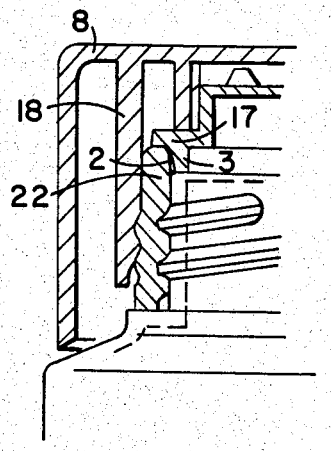
FIG. 11 is an axial lengthwise partial cross-section of the invention illustrated in FIG. 10 in which the container is reclosed.

The fourth example concerns a modified closure device from that of the third example in that a separate skirt is threaded permanently onto the internal threads of a conventional container neck, for example, a commercial glass container. FIG. 10 shows tamperproof cap 4 as including an intermediate element 22 threaded internally and externally beneath closure ring 17. The cap is applied by engagement of the internal threads of skirt 22 on external threads 16 of neck 1. In the position shown in FIG. 10, cover 8 is rotated until rim 7 of key 11 contacts closure ring 17 and with cover key 11 interfitted into tube key 6, rotation of cover 8 relative to the container will suffice to cause the fracturing of the bottom skirt 3. In the case of the third example wherein in the same manner an intervening rim 18 of cover 8 carries means to thread the cover on the intermediate element 22 during the rotation, skirt 3 penetrates into the opening 2 and closure ring 17 contacts the edge of the intermediate element 22 as shown in FIG. 11.

Figure 12:
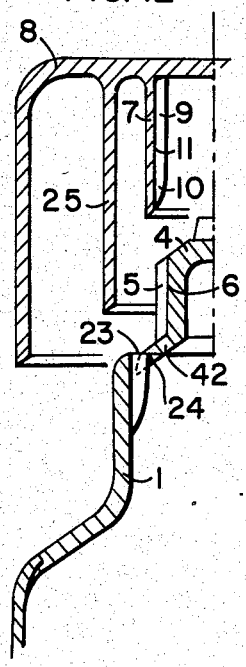
FIG. 12 is an axial lengthwise partial cross-section of the invention wherein the base of the cap includes a flared skirt.

The fifth embodiment concerns a closure in which the base of the cap includes a flared skirt. As in the devices of the preceding examples, the closure device of FIG. 12 comprises a tamperproof cap 4 covering neck 1 of the container. The head of cap 4 comprises the tube key 6 and is equipped with flanges 5 on its circumference. A key 11 inside the cover is provided with a rim 7 and internal ribs 9. Interengagement of the tube key 6 into cover key 11 may be facilitated by tapering the end 10 of each inside rib 9 and/or by an extrusion of rim 7 to include a smooth skirt which initially engages on tube key 6 for alignment of the axes of tube key 6 and cover key 11. The base of cap 4 of the closure device of FIG. 12 is defined by a flared skirt 42, the end 23 of which is frangibly attached to the edge of opening 24 of neck 1. Rim 7 of the cover key 11 which fits within the head of the cap constituting tube key 6 has a smaller outer diameter than that of neck 1. An intermediate smooth rim 25 encases the neck and facilitates mounting of the cover 8 during storage and during resealing.

Figure 13:
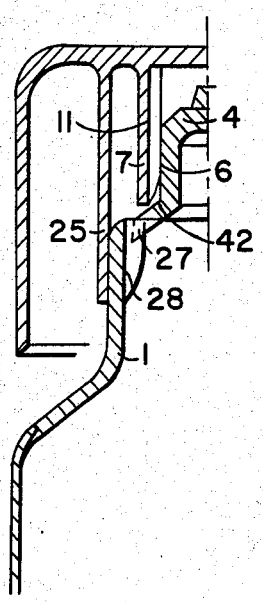
FIG. 13 is an axial lengthwise partial cross-section of the invention illustrated in FIG. 12 with the cover applied.

FIG. 13 illustrates the invention with the cover pushed down on neck 1 and its cap 4. Intermediate rim 25 encircles neck 1 and cover key 11 encircles tube key 6 and the lowermost position of the cover is limited by abutment of the bottom of the skirt of rim 7 on flared skirt 42 of the base of cap 4.

Figure 15:
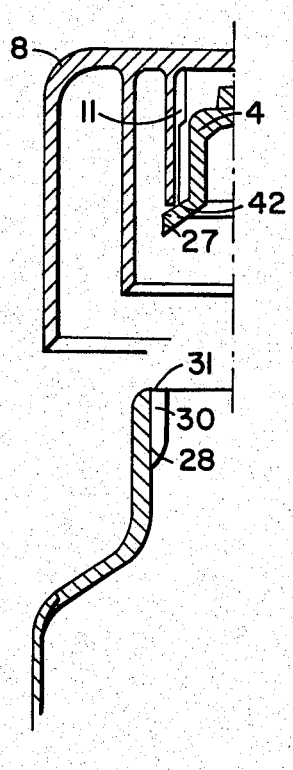
FIG. 15 is an exploded axial lengthwise partial cross-section following breaking the seal of the cap.
Figure 14:
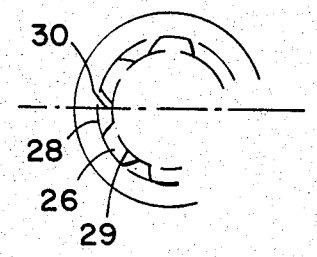
FIG. 14 is a fragmentary plan view of one patterned dispensing opening configuration.
Figure 16:
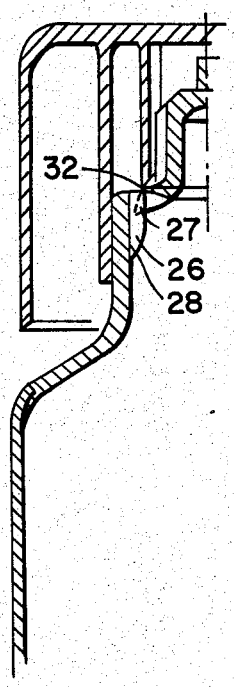
FIG. 16 is an axial lengthwise cross-section of the invention illustrated in FIG. 15 with the container partially reclosed.

FIG. 14 shows the contour of an irregular opening which may correspond to the openings of FIGS. 12, 13, 15 and 16 and is distinguished from the contour of the opening of FIG. 3 in that the recesses 26 are larger thus allowing the lips 27 of FIGS. 13, 14, 16 to extend into the opening in the neck in close proximity with the inside wall of neck 28 and even to engage or adhere to this wall 28. During the molding of the components including injection points 29, the plastic is formed on the flange parts in the areas as at 30 and is projected obliquely into recesses 26 forming lips 27.

FIG. 15 shows the container and its cover 8 following fracturing the seal of cap 4 by rotation of cover 8 from the "cover down" position of FIG. 13. The broken end of flared skirt 42 may allow small fragments of plastic material 31 to be present on flange parts 30. Cap 4 has a force fit within cover key 11 so that it remains captured within cover 8 after breaking of the seal.

FIG. 16 shows the same container at the beginning of the resealing. End 32 of flared skirt 42 engages the edge of the opening and it begins to deflect upwardly. Lips 27 penetrate at least partially into recesses 26.

Figure 17:
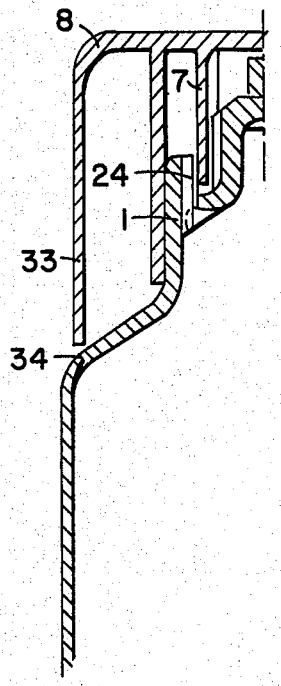
FIG. 17 is an axial lengthwise partial cross-section of the invention of FIG. 16 with the container resealed.

FIG. 17 shows the same container resealed. The skirt of rim 7 of the cover key has an outside diameter approximately equal to or slightly smaller than the smallest inside diameter of opening 24 of neck 1 and it has penetrated into opening 24 during the resealing, thus limiting the volume of residual air in the container and improving the resealing. The limiting position of cover 8 is here controlled by the lengths of its outside skirt 33 which abuts on the shoulder 34 of the container.

Figure 18:
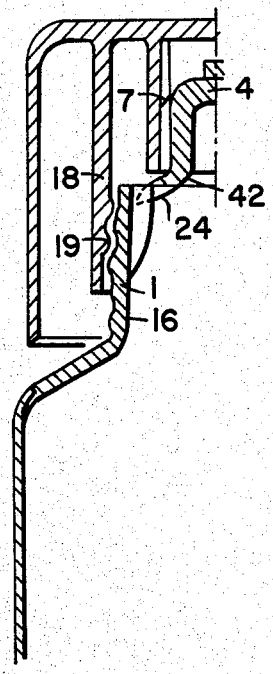
FIG. 18 is an axial lengthwise partial cross-section in which the neck and intermediate rim of the cover are threadably interconnected.

FIG. 18 shows a sixth embodiment of the closure of the present invention. As in the fifth example, the cap with flared skirt 42 can be fitted into opening 24 of neck 1 but the intermediate rim 18 has an internal threaded portion 10 which cooperates with an external threaded portion 16 at the base of neck 1. These threaded portions do not engage as long as the frangible cap is not broken; they cooperate only when the cap is fractured and the cover is further engaged during resealing. In the course of threading engagement, the broken end of flared skirt 32 and particularly the lips which corresponded to the recessed parts, rub lightly against the flange parts which being deflected upwardly.

One particularly practical example is seen in FIGS. 12 and 13. There flanges 5 of the head of cap 4 and internal ribs 9 of key 11 of cover 8 fit together sufficiently by friction that cap 4 is retained by this cover 8. This example concerns both this frictional fitting and the encasement of neck 1 by an intermediate rim 25 present within cover 8. In another manner, opening 24 of neck 1 may be circular and the base of cap 4 is a closure ring with slightly smaller outside diameter than that of the neck opening and is formed perpendicular to the axis of neck 1 so that the bottom edge is secured to the open end of opening 24 of neck 1, thus providing a sealed connection with the local tape which is easy to fracture. This arrangement provides a relatively good seal for resealing the container. This is particularly desirable where the container must contain a foodstuff in paste form which is to be dispensed at several different times.

Dimensionally the components may be configured as follows:

The cylindrical container is formed of low density polyethylene and is 0.4 mm thick. A skirt diameter of 33 mm with a cast head of 0.9 to 1.2 mm thick terminates in a neck 1 with a 17 mm outside diameter and is 12 mm in height. An opening 24 is 11.4 mm in diameter. A cap 4 with an 11 mm diameter and 1 mm thick closure ring at its base is provided with 12 ribs or flanges 5, each of 8 mm total height. The top edge of each flange is chamfered to 45° to facilitate interfitting of key 11 of cover 8. The closure ring is attached by its bottom edge to the mouth of opening 24 of neck 1 with a local taper of the polyethylene to a thickness of approximately 0.3 mm.

The polypropylene cover 8 has a 31 mm outside diameter and 26 mm height, with an intermediate internal rim 25. The intermediate rim is of 20 mm outside diameter × 16.8 mm inside diameter × 19 mm height with its end chamfered inwardly to facilitate the encasement of neck 1. A rim 7 of key 11 of the cover is of 12 mm outside diameter and 11 mm height having 12 inside ribs 9 of 11 mm height with tapered ends.

The ribs 5 on the cap have an 8 mm diameter at the groove bottom and a 10 mm diameter atop the ribs, they have a 60° right cross-sectional profile.

The inside ribs of key 11 of cover 8 have a between-ribs diameter of 8.2 mm and between-groove bottoms diameter of 10.2 mm with a 60° right cross-sectional profile.

It has been established that following breaking the seal of cap 4, the cap is retained by key 11. This is achieved because of the frictional fit between the flanges and ribs which are interdigitated to a distance of 8 to 10 mm. Retention can also be achieved as a result of slight deformation of flanges and ribs due to the relative force of rotaion exerted on the cap until it is fractured by shearing of its tapered portion. At the same time, an initial fitting is obtained smoothly with sufficient minimal force to retain cap 4 within key 11 of cover 8 following fracturing of the seal of cap 4. Upon resealing, the broken closure ring penetrates into the dispensing opening slightly by force and with very slight play providing a relatively good seal.

We claim:

1. A closure for a necked container comprising in combination:

(1) a container body terminating at one end in a necked portion including means defining a dispensing outlet;

(2) a frangible, separable tamperproof cap including a frangible zone integrally secured to said necked portion and over said outlet;

(3) a plurality of externally disposed spaced radially extending vertically oriented flanges carried by said cap;

(4) a cover for said container including a portion configured to encircle said neck and said cap and provided with a plurality of radially inwardly directed rib members selectively axially engageable with said flanges on said cap for imparting rotational movement to said cap sufficient to fracture said cap from said neck;

(5) and retention means for securing said cover to said container prior to, during and after fracture of said cap and separation thereof from said dispensing outlet of said container neck.

2. The invention defined by claim 1 wherein said cover includes a coaxial internal rim and said ribs are carried by said rim for selective engagement with said flanges on said cap.

3. The invention of claim 2 wherein said rim includes an aligning skirt portion below said ribs and dimensioned to engage said neck of said container.

4. The invention of claim 2 wherein said cover includes an intermediate coaxial rim between said cover and said internal rim dimensioned to embrace the neck of said container when said cover is positioned on said container.

5. The invention of claim 1 wherein said tamperproof cap includes a portion adjacent said frangible zone engageable with said dispensing outlet for reclosing said outlet after said seal is broken.

6. The invention of claim 5 wherein said cap includes an annular closure ring positioned above said frangible one and extending radially outwardly a distance sufficient to engage said neck when said cover is applied to said container after fracture of said tamperproof seal.

7. The invention of claim 5 wherein said cap further includes a tapered lower extremity configured to enter and close said dispensing outlet when said container is reclosed after fracture of said frangible cap from said container.

8. The invention of claim 5 wherein said cap includes a flared portion adjacent said frangible zone dimensioned to engage the mouth of said dispensing opening to reseal said opening after said frangible zone has been broken.

9. The invention of claim 8 wherein said flared portion is configured to extend into the mouth of said dispensing opening and into said neck when said container is resealed after initial opening.

10. The invention of claim 1 wherein said retention means includes complementary threaded areas on said neck and said cover.

11. The invention of claim 1 wherein said cap is frictionally retained within said cover when said frangible zone has been broken and said cover removed from said container.

* * * * *